United States Patent [19]

Pfaffle

[11] 4,129,156

[45] Dec. 12, 1978

[54] METHOD AND CONSTRUCTION FOR SPIRAL WIRE BINDING OF PADS

[75] Inventor: Ernst Pfaffle, Neuffen, Germany

[73] Assignee: Ricoh Company, Ltd., Tokyo, Japan

[21] Appl. No.: 823,634

[22] Filed: Aug. 11, 1977

[51] Int. Cl.[2] ..... B21F 11/00

[52] U.S. Cl. ..... 140/92.4; 140/92.7; 83/907

[58] Field of Search ..... 140/92.7, 92.94, 92.4; 83/513, 598, 907

[56] References Cited

U.S. PATENT DOCUMENTS

| | | | |
|---|---|---|---|
| 1,144,750 | 6/1915 | Bluege | 83/598 |
| 2,621,738 | 12/1952 | Pessina | 83/513 |
| 3,731,574 | 5/1973 | McCarthy et al. | 83/598 |
| 3,924,664 | 12/1975 | Pfaffle | 140/92.7 |
| 3,924,665 | 12/1975 | Spuhl | 140/92.7 |

*Primary Examiner*—Lowell A. Larson
*Attorney, Agent, or Firm*—David G. Alexander

[57] ABSTRACT

A machine for feeding and simultaneously binding pairs of relatively small spiral wire bound pads. Groups of sheets of twice the final desired size are fed serially to a station where they are split and separated. Pairs of the split pads are then fed through a conventional coil binding machine having stations where they are successively aligned and receive a single spiral binder while in side-by-side and slightly spaced relationship. At the next station cutter means are provided for simultaneously trimming and inwardly bending both the outer and the inner ends of the binders of both pads. The two trim-cutting and bending assemblies for the outer ends are of conventional construction having a fixed cutter member and a movable blade operated by a cam with a diagonal slot. The trim-cutting and bending assembly for the inner ends however is of novel construction, comprising two fixed cutter members carried by a single arm and spring-urged movable cutter blades actuated by a V-shaped cam on another arm.

6 Claims, 4 Drawing Figures

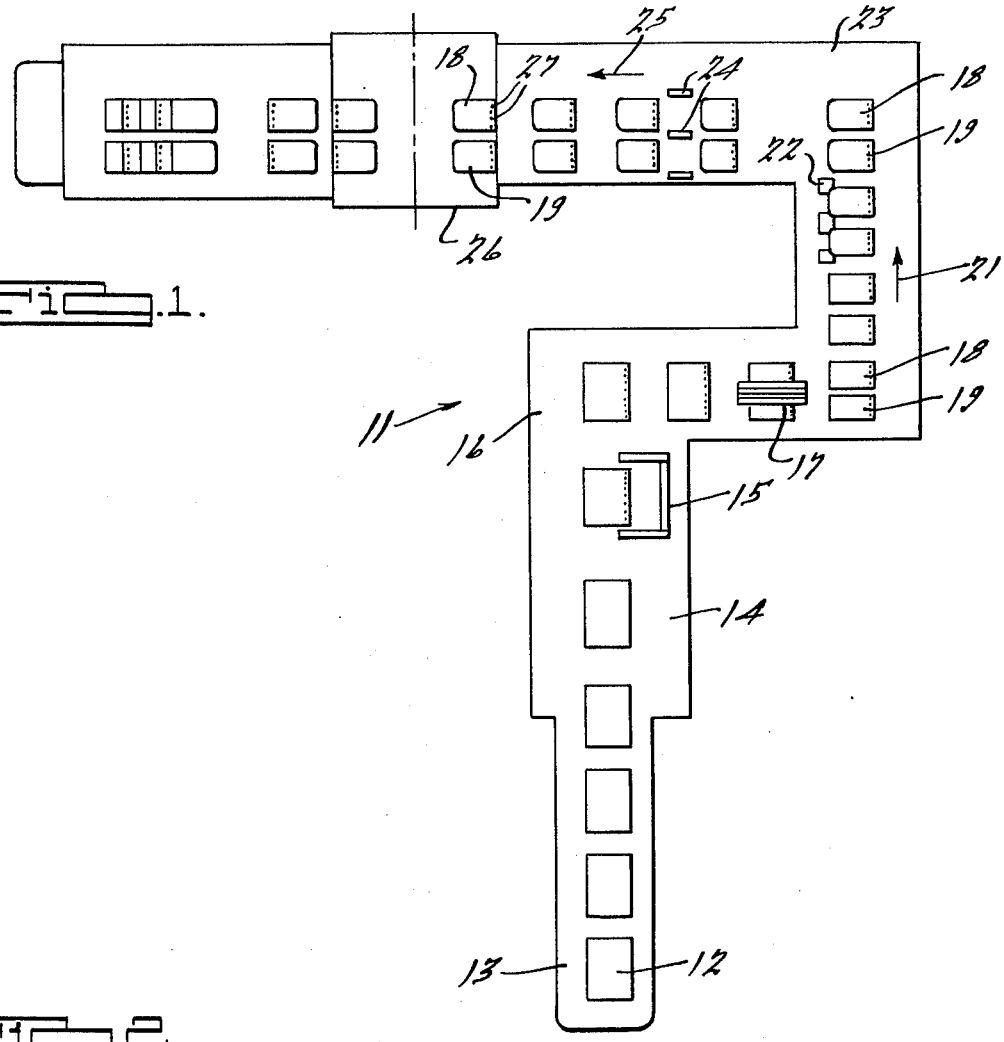
Fig. 1.
Fig. 2.
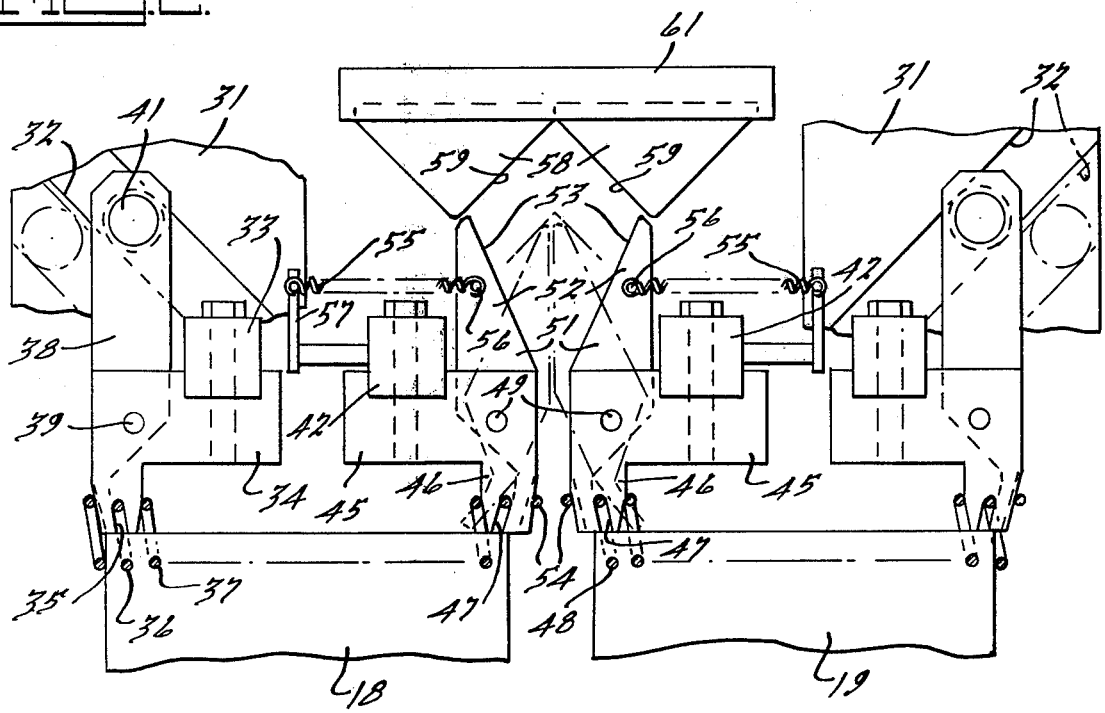

FIG. 3.
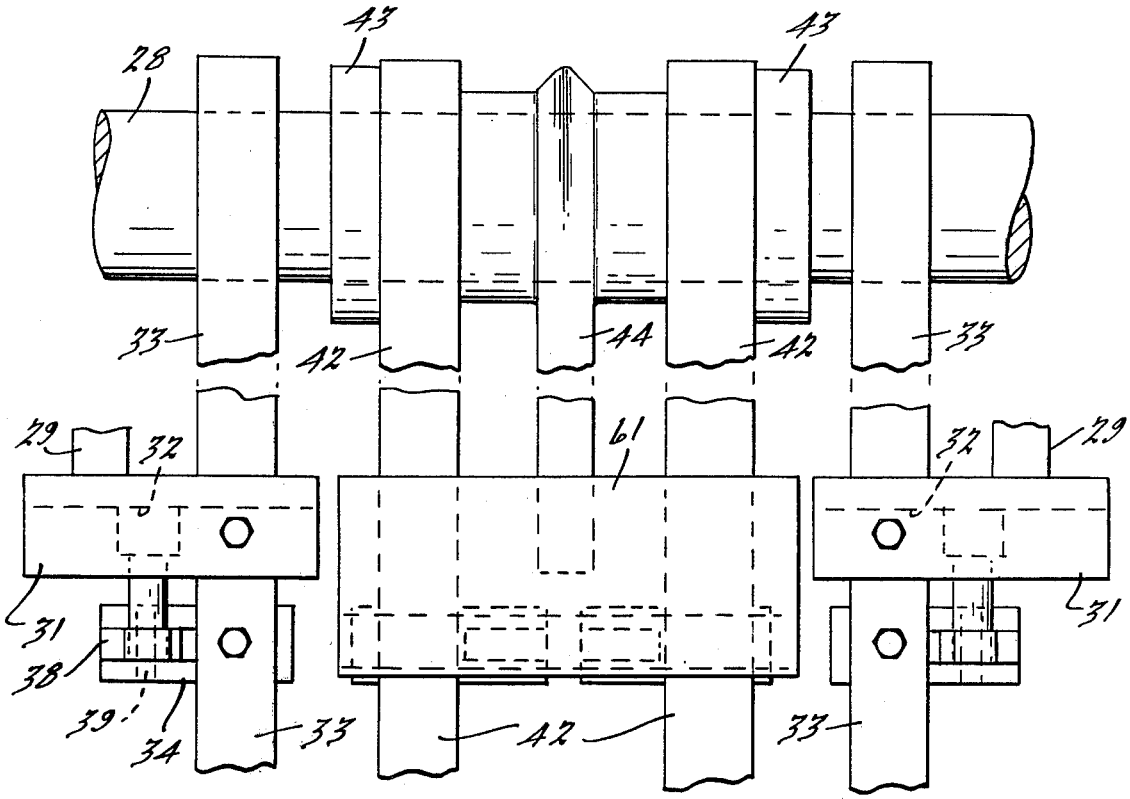
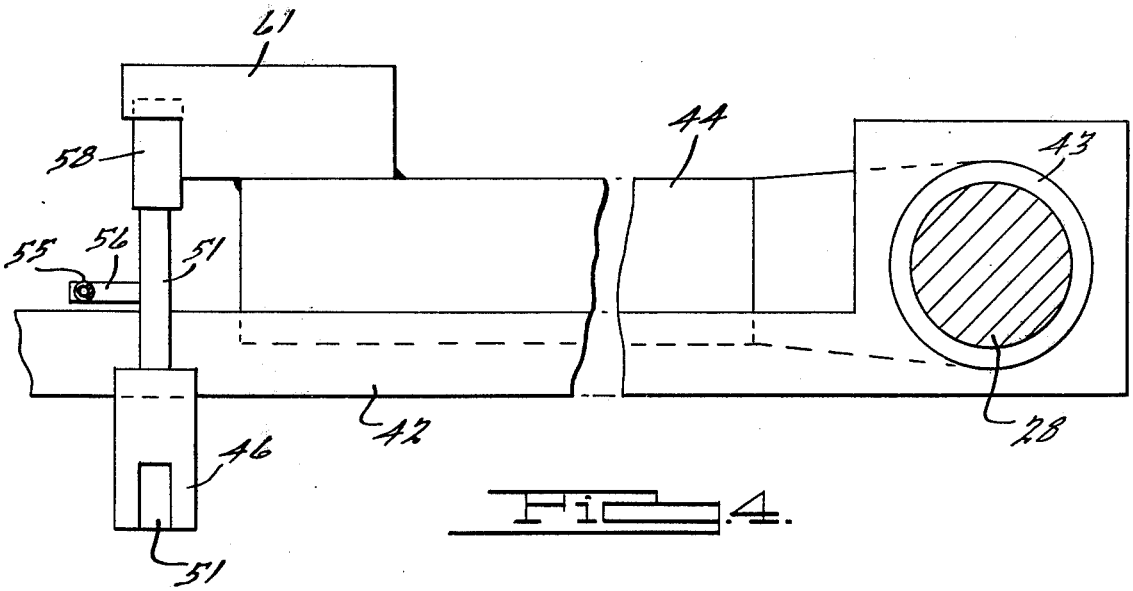
FIG. 4.

METHOD AND CONSTRUCTION FOR SPIRAL WIRE BINDING OF PADS

BACKGROUND OF THE INVENTION

1. Field of the Invention

The invention relates to the spiral wire binding of stacks of sheets, particularly pads or booklets of smaller sizes, such as 6 inch by 9 inch steno pads or similar books.

2. Description of the Prior Art

An example of a coil binding machine used for this purpose is shown in my U.S. Pat. No. 3,924,664 and the patents referred to therein. In these machines, groups of sheets are fed to a perforating mechanism such as a punching unit and from there to a rotating carriage at which each pad is fed to successive stations. At one station the outwardly positioned holes are aligned, at another station a spiral wire binder is fed therethrough and severed from the supply, and at a third station the outer ends of the spiral are trim-cut and bent inwardly.

When a smaller size pads are used in this rotating unit, it is possible for such a machine to bind more booklets per unit of time because the time for feeding each coil is less than for longer edges. However, the speed of the operator who manually feeds the booklets at the beginning of the line remains the same regardless of the size of the book. The rotating unit is thus not operating at its potential capacity.

The conventional trim-cutting and bending apparatus, as shown in the above-mentioned prior art, comprises an assembly having a fixed cutter member which engages the spiral end and a cutter blade operated by a cam having a diagonal slot. Because of the bulky nature of this prior trim-cutting and bending assembly, it is possible to use such a construction to trim-cut and bend two closely spaced spiral binder ends.

BRIEF SUMMARY OF THE INVENTION

It is an object of the present invention to increase the binding capacity of the spiral binding machines of this nature for smaller size pads while still maintaining efficiency and reliability.

It is another object to achieve this increased production capacity while at the same time conserving to a maximum degree the wire material used in the spiral binding.

It is a further object to provide an improved binding mechanism of this character which permits the trim-cutting and inward bending of two closely spaced spiral binder ends in a rapid and efficient manner.

Briefly, the method of this invention comprises the steps of serially feeding groups of sheets perforated along one edge in one direction, evenly dividing each group so as to create two groups side by side, separating said two groups a relatively small distance, feeding a continuous spiral wire through the perforations of both groups while in said closely separated side-by-side relation, and simultaneously trim-cutting and bending both the outer and inner ends of the spiral wire binder passing through both groups while they remain in said closely spaced side-by-side relation.

The structure of this invention comprises, in a coil binding machine of the type having a carriage, means on said carriage for supporting a pair of perforated sheet groups in closely spaced side-by-side relation, and means for moving said carriage to successive stations for aligning, coil feeding, and trim-cutting and bending said coils, the improvement comprising a trim-cutting and bending assembly for the adjacent ends of said side-by-side sheet groups, said assembly comprising a pair of fixed cutter members engageable with said adjacent coil ends, a cutter blade pivotally mounted on each cutter member and movable between a retracted position and a cutting position, spring means urging each cutter blade to its retracted position, the blades having cam followers extending therefrom, and a V-shaped cam having side surfaces simultaneously engageable with said followers to urge said blades toward their cutting positions against the action of said spring means.

BRIEF DESCRIPTION OF THE DRAWINGS

FIG. 1 is a schematic plan view of an apparatus for carrying out the invention;

FIG. 2 is a front elevational view of the mechanism of this invention;

FIG. 3 is a top plan view thereof; and

FIG. 4 is a side elevation view of the apparatus.

DESCRIPTION OF THE PREFERRED EMBODIMENT

FIG. 1 shows the overall arrangement, generally indicated at 11, for perforating, splitting, separating and binding books 12, comprising groups of sheets with backs and tops. These may, for example, be originally 9 × 12 inches in size but are to be used to fabricate booklets which are 6 × 9 inches. The sheet groups are fed onto the equipment at location 13, this operation normally being hand feeding by an operator standing alongside the apparatus. In area 14 the sheet groups are separated into "lifts", that is, each group is separated into parts for perforating at a punching station 15. The parts are reassembled in area 16 and are fed to a splitting mechanism 17, this feeding movement being at right angles to the previous direction of movements so as to obtain two smaller sheet groups 18 and 19. Each pair of sheet groups is fed at right angles to the previous direction of movement during the splitting action. If desired, a transport mechanism indicated schematically at 21 separates each pair of sheet groups 18 and 19 for corner rounding by mechanism shown diagrammatically at 22. This step will be optional for certain types of booklets, such as memo pads. The pairs of sheet groups 18 and 19 are then fed at right angles to the movement created by transport mechanism 21. Starting in the area indicated at 23, guide means shown schematically at 24 are provided for guiding both side edges of each booklet in each pair.

The transport mechanism shown schematically at 25 on this leg of the system will move each pair of sheet groups 18 and 19 onto a carriage illustrated schematically at 26 with the perforations 27 positioned outwardly. This carriage may be of the type shown in the aforementioned U.S. Pat. No. 3,924,664 and is adapted to receive each pair of books 18 and 19 in closely spaced side-by-side relation for movement to the various stations.

At the first station after the horizontal receiving station, the perforations in the pairs of booklets are aligned. At a succeeding station, a mechanism will pass a spiral binder wire coil simultaneously through both booklets and will sever that coil from the supply wire. The booklets are then advanced by the carriage to a coil trim-cutting and bending station and finally to another horizontal station which is the exit station. All these are shown in more detail in the previously mentioned patents.

The structure of this invention is concerned with the mechanism for trim-cutting and bending the two adjacent ends of the spiral wire binders for the two booklets 18 and 19 in each pair. The means for trim-cutting and bending the outer ends of the two spiral binders is essentially the same as that shown and described in the previous patents and is partially shown in the drawings of the present application. This means includes an oscillating shaft 28 which is moved in synchronism with carriage 26. A pair of arms 29 are fixed to this shaft and carry cams 31 with diagonal slots 32. A pair of arms at 33 are rotatably mounted on shaft 28 and carry fixed cutter members 34. These cutter members have downwardly facing slots at 35 so that teeth formed at the lower ends of the cutter members may partially surround a turn 36 of coil 37 which binds booklets 18 and 19. The cutter members have blades 38 pivoted at 39 and movable between a retracted position and a cutting position. The blades have pins 41 disposed in slots 32.

This conventional cutting mechanism operates as follows, as described in the aforementioned patents: At the trim-cutting and bending stations, arms 29 and 33 descend together, but arms 33 engage a stop at the time that slots 35 surround coils 36. Arms 29 continue to move, however, and this causes the diagonal slots 32 to rock blades 38 to their cutting position.

While this mechanism is satisfactory for the outside ends, it could not be used for trim-cutting and bending the inner adjacent coil ends of the two booklets because of its bulk and size. The invention comprises a pair of arms 42 rotatably mounted on shaft 28 inwardly of arms 33. Collars 43 may be provided for holding arms 42 in position, and the hub of an arm 44 fixed to shaft 28 is disposed between arms 42 for purposes described below.

Arms 42 carry cutter members 45, each cutter member having a downward extension 46. These downward extensions carry slots 47 similar to slots 35 for engaging the coil 48 at the inner adjacent ends of booklets 18 and 19. Like the construction of cutter members 34, slots 47 are formed with a pair of teeth, between which is pivoted at 49 a cutter blade 51.

Cutter blades 51 are not shaped like cutter blades 38 but instead, their upper ends 52 comprise tapered extensions. In their retracted positions as shown in FIG. 2, surfaces 58 of these extensions angle away from each other in an upward direction. However, when the blades are moved to their cutting positions, surfaces 53 will be substantially parallel to each other. Thus, the two cutter members and their blades may be located very close to each other. For example, in the illustration, only two coils 54 of the spiral binder wire will be wasted after the trim-cutting and bending takes place.

Cutter blades 51 are urged to their retracted position by a pair of helical coil tension springs 55. One end of each spring is secured to a pin 56 carried by extension 52 and the other to a fixed post 57 carried by arm 42.

The means for actuating the blades 51 comprises a V-shaped cam 58 having a pair of divergent surfaces 59 which are engageable with the noses of blade extensions 52. Cam 58 is carried by arm 44, the arm having a bracket 61 at its outer end to which cam 58 is secured. The construction of cam 58 is such that it occupies considerably less lateral distance for the purpose of actuating the two cutter blades than would a structure such as cam 31 with diagonal slots 32.

In operation, all four trim-cutting and bending assemblies will approach the pair of booklets 18 and 19 simultaneously. The action of the outer assemblies may not be described since it is conventional. Referring to the inner assemblies, as slots 47 of cutter members 45 engage their respective coils, arms 42 will engage stop means. Arm 44 will continue to rock so that cam surfaces 59 will engage blade extensions 52 and rock blades 51 into their cutting positions. Retraction of the cam 58 will permit springs 55 to return blades 51 to their retracted positions. All four trim-cutting and bending assemblies will be simultaneously retracted from the booklets which will then be advanced to the next station.

It will be observed that the lateral distances between the cutter assemblies may be varied by adjustment along shaft 28.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. In a coil binding machine of the type having a carriage, means on said carriage for supporting a pair of perforated sheet groups in closely spaced side-by-side relation, and means for moving said carriage to successive stations for aligning, coil feeding, and trim-cutting and bending said coils, the improvement comprising a trim-cutting and bending assembly for the adjacent ends of said side-by-side sheet groups, said assembly comprising a pair of fixed cutter members engageable with said adjacent coil ends, a cutter blade pivotally mounted on each cutter member and movable between a retracted position and a cutting position, spring means urging each cutter blade to its retracted position, the blades having cutting portions at one end and cam followers extending therefrom, at the other end, the pivots being located between these ends whereby the ends will swing in opposite directions, and a V-shaped cam having side surfaces simultaneously engageable with said followers to urge said blades toward their cutting positions against the action of said spring means.

2. The combination according to claim 1, further provided with an oscillating shaft movable in synchronism with said carriage, said cutter members being supported by arms rotatably mounted on said shaft, said cam being supported by an arm fixed to said shaft.

3. The combination according to claim 2, further provided with trim-cutting and bending assemblies for the outer ends of said sheet groups, each of said last-mentioned assemblies comprising a cutter member supported by an arm rotatably mounted on said oscillating shaft, a cutter blade pivoted on said cutter member, and a cam for operating said cutter blade and carried by an arm fixed to said oscillating shaft.

4. The combination according to claim 1, said blade extensions being tapered, the facing edges of said extensions being so shaped as to be in approximately parallel relation when the blades are shifted to their cutting position.

5. The combination according to claim 1, spring means comprising a helical coil tension spring connected to each blade extension.

6. A method for coil binding relatively small booklets comprising the steps of serially feeding groups of sheets perforated along one edge in one direction, evenly dividing each group so as to create two groups side by side, separating said two groups a relatively small distance, feeding a continuous spiral wire through the perforations of both groups while in said closely separated side-by-side relation, and simultaneously trim-cutting and bending both the outer and inner ends of the spiral wire binder passing through both groups while they remain in said closely spaced side-by-side relation.

* * * * *

UNITED STATES PATENT AND TRADEMARK OFFICE

CERTIFICATE OF CORRECTION

PATENT NO. : 4,129,156

DATED : December 12, 1978

INVENTOR(S) : Ernst Pfaffle

It is certified that error appears in the above-identified patent and that said Letters Patent are hereby corrected as shown below:

Column 1, line 4, "Ricoh Company, Ltd., Tokyo, Japan" should be -- Hans Sickinger Co., Pontiac, Mich. --;

Column 1, line 35, "possible" should be -- impossible --;

Column 3, line 48, "58" should be -- 53 --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*